US005335711A

United States Patent [19]

Paine

[11] Patent Number: 5,335,711

[45] Date of Patent: Aug. 9, 1994

[54] PROCESS AND APPARATUS FOR METAL CASTING

[75] Inventor: Brian Paine, Bradford, Great Britain

[73] Assignee: AE PLC, Rugby, England

[21] Appl. No.: 876,706

[22] Filed: Apr. 29, 1992

Related U.S. Application Data

[63] Continuation of Ser. No. 655,232, Jan. 17, 1991, abandoned, which is a continuation of Ser. No. 191,958, May 9, 1988, abandoned.

[30] Foreign Application Priority Data

May 30, 1987 [GB] United Kingdom ..... 8712742

[51] Int. Cl.[5] ..... B22D 27/13

[52] U.S. Cl. ..... 164/66.1; 164/65; 164/120; 164/122; 164/136; 164/258; 164/335

[58] Field of Search ..... 164/120, 61, 65, 66.1, 164/67.1, 68.1, 122, 122.1, 122.2, 125, 253, 254, 256, 258, 136, 335

[56] References Cited

U.S. PATENT DOCUMENTS

| | | | |
|---|---|---|---|
| 3,420,291 | 1/1969 | Chandley et al. | 164/66.1 |
| 3,532,155 | 10/1970 | Kane et al. | 164/65 X |
| 3,841,384 | 10/1974 | Tingquist et al. | 164/122.1 |
| 3,845,808 | 11/1974 | Higginbotham et al. | 164/122 X |

FOREIGN PATENT DOCUMENTS

| | | |
|---|---|---|
| 1483645 | 9/1969 | Fed. Rep. of Germany . |
| 3220744 | 12/1983 | Fed. Rep. of Germany . |
| 1247632 | 9/1971 | United Kingdom . |
| 1356890 | 6/1974 | United Kingdom . |
| 1489892 | 10/1977 | United Kingdom . |
| 2163684A | 3/1986 | United Kingdom . |

*Primary Examiner*—J. Reed Batten, Jr.
*Attorney, Agent, or Firm*—William R. Hinds

[57] ABSTRACT

Cast components having reduced porosity levels are produced by pouring a molten metal into a mould which is in a first chamber, and withdrawing the filled mould into a second chamber. The second chamber is then isolated from the first chamber with regard to pressure, and the second chamber is then pressurized with a fluid up to a maximum pressure of 7 MPa for at least part of the time required for solidification of the metal in the mould. The pressure is preferably applied within forty seconds from the finish of pouring of the molten metal, and more preferably within twenty seconds. The still molten state of the metal permits the use of a relatively low pressure to reduce the porosity levels.

12 Claims, 5 Drawing Sheets

PROCESS AND APPARATUS FOR METAL CASTING

This is a continuation of application Ser. No. 655,232 filed Jan. 17, 1991, which is a continuation of Ser. No. 191,958 filed May 9, 1988, both now abandoned.

The present invention relates to a process and apparatus for the casting of molten metal.

Many components used in the manufacture of gas turbine engines are precision cast to shape by investment casting methods such as the lost wax process. Other articles such as turbocharger components, for example, may also utilise such manufacturing methods.

In the gas turbine engine industry there are three distinct types of metallurgical grain-structures with which components are produced. These structures are equiaxed (EA), directionally solidified (DS) having directionally orientated columnar grains and single or mono crystalline (SX) components.

EA components were the first precision cast components to be used commercially in gas turbine engines. Both DS and SX components were later developments.

In the production of an EA turbine blade, for example, many, often conflicting, variables are present. The components often comprise a relatively thick and heavy root portion at one end, a somewhat less thick and heavy shroud portion at the other end and the two portions being joined by an often relatively long, thin sectioned airfoil portion. In many instances the component also has hollow passages therein which result in the wall section of the airfoil portion becoming even thinner.

Because of the variations in section of typical components they are very susceptible to the formation of porosity during solidification.

In the case of EA components there is little or no control of solidification other than that imposed by the external runner and feeder system. The feeder system is usually arranged so that it is the last metal to solidify in an attempt to ensure liquid metal supply to the solidifying component. In the case of airfoils secondary feeders are sometimes supplied at thin sections to try to keep liquid metal available and so prevent or minimise shrinkage porosity from forming. Such measures, however, can cause unacceptable variations in grain size which may result in the component being rejected. Engine manufacturers place specifications of maximum acceptable porosity and distribution thereof on components. There are expended, therefore, considerable resources in non-destructive testing etc. to identify substandard components.

Chandley et al in U.S. Pat. No. 3,420,291 proposes a method of reducing or eliminating residual porosity by pressurisation of the solidifying metal. He proposes a pressure vessel either within which the mould may be heated or within which a heated mould may be placed. The pressure vessel itself must be contained within a vacuum melting and casting chamber in the case of typical turbine component alloys. Molten metal is poured under vacuum into the mould after which a closure member on the pressure vessel is fixed into position and the vessel pressurised with a gas which is non-reactive with the molten metal. A pressure of from 1,000 to 4,000 p.s.i. is specified with 2,000 to 3,000 p.s.i. being the preferred range. Although apparently producing significant improvements in soundness of the cast components this method has not been adopted in the industry. The reasons for this non-adoption lie essentially in the complication of use of the apparatus described and also possibly in the potential safety hazard. Firstly, it is necessary to heat the mould or the interior of the vessel and place the mould inside the vessel. Since the vessel and mould are both required to be inside vacuum casting furnace it is then necessary to close the vacuum casting furnace and pump down to the required pressure. In a typical furnace large enough to house the vessel assembly this may take upwards of 15 minutes. Once at the required pressure the metal charge has then to be melted and brought to a stable temperature before casting. This also requires about 10 minutes. After the metal has been cast into the mould the pressure vessel requires to be sealed up and pressurised. With the vessel isolated in a vacuum chamber this is extremely difficult to do requiring complicated remote handling mechanisms passing through the walls of the vacuum chamber. The time to seal up the pressure vessel may be in excess of 3 minutes. The vacuum casting furnace is then occupied whilst the molten metal solidifies. It is very difficult, therefore, to achieve better than one or at most two casts per hour. Due to the relatively long time required to seal the pressure vessel the metal is partly solidified before the pressure is applied and thus to achieve a given result the pressure required to be applied is high; up to 4,000 p.s.i. The pressure vessel itself needs to be tested at pressures, perhaps several times the maximum projected operating pressure to ensure safety. An additional variable is that the pressure vessel itself heats up due to radiated heat from the mould or mould heating means thus weakening the material from which the vessel is constructed. There are, therefore, considerable safety hazards involved.

An alternative method which has been employed is that of hot isostatic pressing. Some internal porosity may be sealed by this technique but it is very expensive and the technique has no effect on surface-connected porosity. For some applications some engine manufacturers will not accept components which have been so treated.

DS and SX components are produced in essentially the same types of vacuum furnace. The moulds are constructed upon a water cooled chill plate which is part of the end of a position and speed controllable ram. The moulds are uninsulated and pre-heated in situ in the casting chamber by radiant heating. The cold mould is raised to the casting position by the ram, heated in the casting position to the desired temperature by radiant heating means, Mould temperatures up to 1600° C. may be attained. The molten metal is cast into the mould where it is maintained in the molten condition. Solidification is initiated by slowly withdrawing the mould on the ram from the radiant heating zone such that an essentially planar solid/liquid interface is produced. The solidifying metal is continually fed with liquid metal so that shrinkage or gas porosity is never able to form or become entrapped as there are no closed pockets of liquid metal within solidified metal. The effect of such a solidification method on the structure, however is to produce directionally orientated columnar grains in DS components or a single crystal in SX components where, in the latter, special initial additional steps are taken.

Whilst DS and SX components are invariably sound with regard to porosity they are only used in very arduous applications in some parts of some engines because of the benefits which accrue from the metallurgical structure produced. DS and SX components are expensive to produce because of the relatively slow solidification rate.

For the forseeable future the major proportion of precision cast gas turbine engine components will be of the EA type. It is highly desirable for economic reasons to reduce the level of scrap produced due to the porosity in EA components. A typical scrap level for an EA component may be 30% and for some particularly difficult components the scrap rate may rise to over 50%. It is also economically desirable to be able to pre-heat moulds in situ in the casting furnace in order to eliminate the costly pre-heating stage in external furnaces which is normal with the types of furnace employed for EA castings.

It is also desirable to be able to produce EA, DS and SX components in the same type of furnace with the mimimum amount of alteration.

According to a first aspect of the present invention, apparatus for the production of cast metal components comprises a mould, a casting chamber, metal melting and metal pouring means, a mould chamber adjacent the casting chamber and connected thereto by valve means of sufficient size to allow the mould to pass therethrough, vacuum pump means for producing a reduced pressure in at least the casting chamber, mould heating means, mould moving means to transport the mould between the mould chamber and the casting chamber, and pressurising means connected to the mould chamber for pressurising the mould chamber with a fluid to a pressure sufficient to achieve at least substantial reduction in shrinkage porosity void formation during solidification of molten metal in the mould chamber, wherein the valve means, the mould moving means and the pressurising means are constructed and arranged such that a mould with molten metal therein can be moved from the casting chamber to the mould chamber, the valve means closed and the mould chamber pressurized, all within a time such that the metal is still molten. The provision of mould heating means by, for example, resistance heated molybdenum or induction heated graphite radiant heaters preclude the necessity of having external pre-heating furnaces and attendant mould insulation and allows higher temperature capability together with greater accuracy and flexibility of pre-heating temperatures.

The mould chamber may also include internal variable thickness insulation to coincide with selected portions of a particular mould in order to achieve different cooling rates in selected portions of the filled mould.

The mould chamber may also include radiant heating means for selectively heating parts of the filled mould.

In one embodiment of an apparatus according to the present invention the mould chamber is situated below the casting chamber. The mould moving means may comprise a ram operated, for example, by hydraulic or electrical means and moving the mould vertically from the mould chamber to the casting chamber and back again via the valve means.

The mould moving means may also comprise insulation between the mould and its seat on the mould moving means. In the case of production of EA components such insulation may be necessary to prevent excessively directional heat flow out of the mould by conduction. For DS and SX components it will be necessary to have direct contact between the mould and cooling means associated with the mould moving means to promote directional heat flow out of the mould.

The mould chamber is constructed as a pressure vessel and separated from the furnace chamber by valve means comprising a rapidly acting isolating valve. For EA components the mould containing the cast molten metal may be rapidly retracted into the mould chamber, the isolating valve shut and the mould chamber pressurised with a fluid such as argon, for example. The mould may be retracted into the mould chamber, isolated and pressurised within approximately 10 to 20 seconds of the metal being poured. Due to this short time interval it has been found that the pressures required to achieve substantial reduction or elimination of residual porosity may be reduced to under 1,000 p.s.i. (6.9 MPa) in general and for most applications to less than 500 p.s.i. (3.45 MPa). This has advantages both in terms of safety of the process due to lower pressures and in economic terms due to lower capital cost of equipment.

The apparatus may, however, be constructed to withstand any desired pressure consistant with engineering and safety requirements. There is no reason, should it be so desired, why the mould chamber could not be constructed to withstand 35 MPa, for example.

The apparatus may be used for the production of DS and SX components although the pressurisation facility is not necessary in the case of such components because of the solidification mechanism. This has the advantage, however, that complete flexibility is available to the manufacturer in that the casting apparatus may be used for the production of any type of component.

Because the mould chamber and its associated apparatus is relatively compact two or more mould chambers may be serviced by one casting chamber. Greater output of castings may be achieved in this manner since the casting chamber is available whilst the castings in one mould chamber are solidifying.

According to a second aspect of the present invention, a process for the production of castings comprises the steps of at least partially melting a metal charge, pouring the metal into a mould which is in a first chamber, withdrawing the filled mould completely into a second chamber while the metal in the mould is still in a molten state, isolating the second chamber from the first chamber with regard to pressure and then pressurising the second chamber with a fluid up to a maximum pressure of 7 MPa such as to tend to preclude shrinkage porosity void formation for at least part of the time required for solidification of the metal in the mould.

In a preferred embodiment of the process the time between the finish of pouring of the metal and the application of pressure may be less than 40 seconds. In a more preferred embodiment this time may be less than 20 seconds. The more quickly the pressure is applied to the cast metal after pouring the lower is the pressure required to effect a given reduction in porosity. This of course pre-supposes other constant parameters such as equal metal pouring temperatures, mould pre-heat temperatures, mould design and construction, for example.

The apparatus and process of the present invention may be used to cast a wide variety of metals and alloys including, for example, copper and aluminium alloys as well as iron-, nickel- and cobalt-based superalloys.

In order that the present invention may be more fully understood examples will now be described by way of illustration only with reference to the accompanying drawings, of which:

Figure 6:
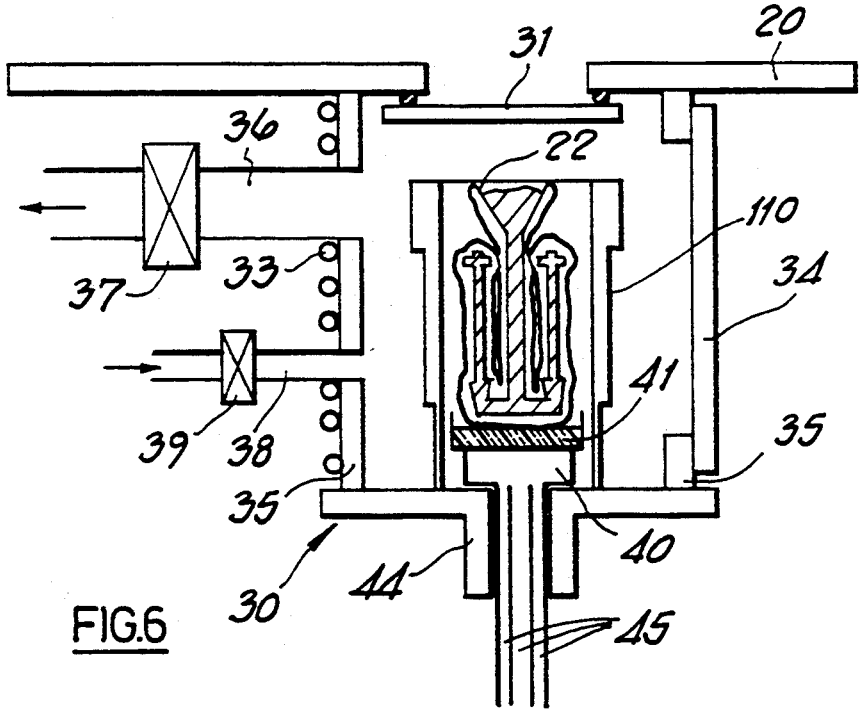

FIG. 6 which shows a modification to a mould vacuum/pressure chamber.

Figure 1:
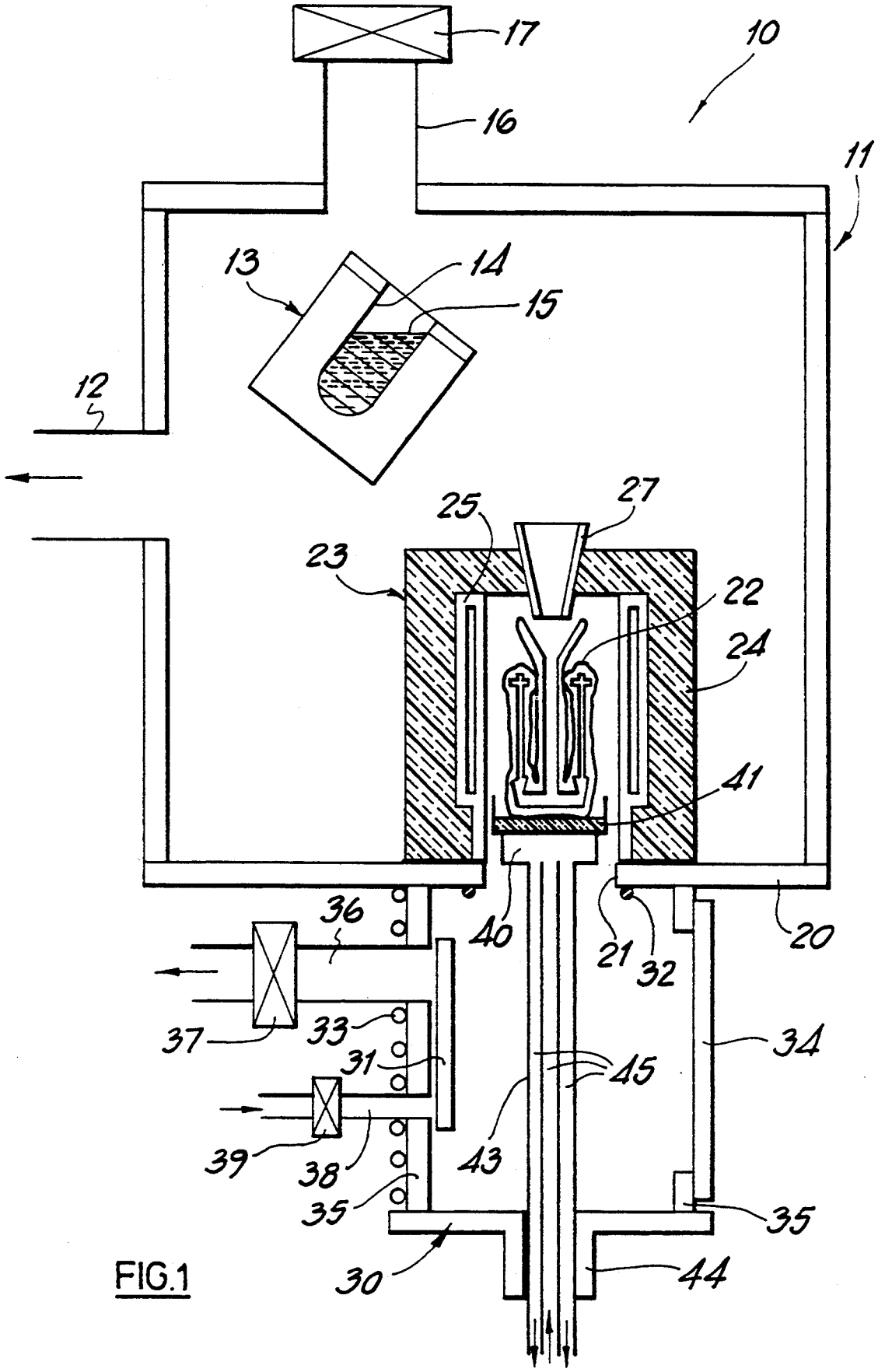
FIG. 1 shows a schematic section through a first embodiment of apparatus according to the present invention with a mould therein immediately prior to casting molten metal.
Figure 2:
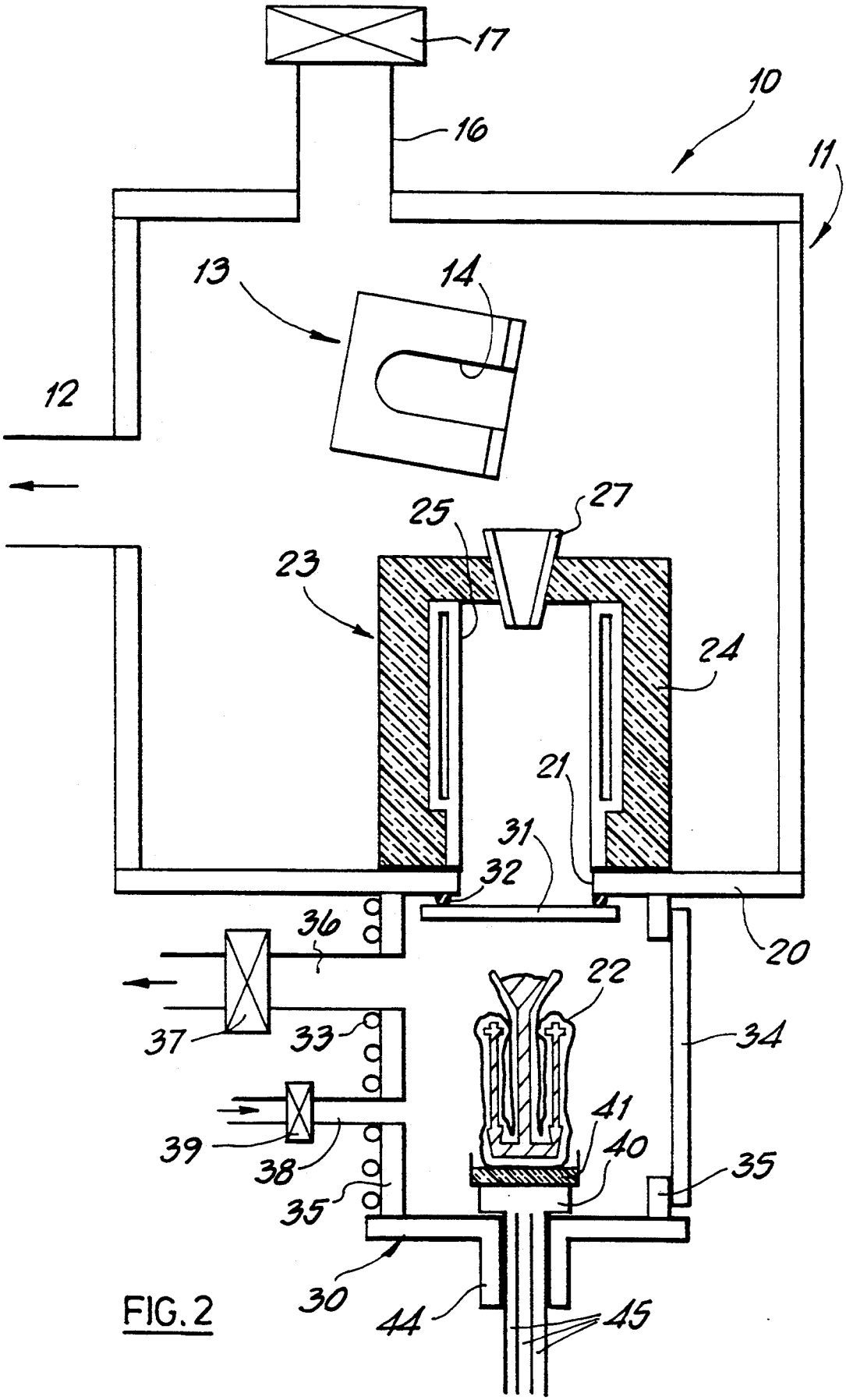
FIG. 2 shows the apparatus of FIG. 1 after casting of molten metal.

Referring now to FIGS. 1 and 2 and where the same features are denoted by common reference numerals.

Apparatus for casting of components is shown generally at 10. The apparatus includes a vacuum casting chamber 11 having a port 12 connected to a vacuum pump (not shown). Contained in the chamber 11 is a coil box assembly 13 having induction heating coils (not shown) and crucible 14; the assembly 13 being mounted such that it may be tilted to pour the molten metal 15 in known manner. Also included in the chamber construction is a port 16 and a vacuum lock 17 to enable the crucible 14 to be recharged with fresh metal whilst under vacuum. In the bottom wall 20 of the chamber 11 is an aperture 21 of sufficient size to allow a mould assembly 22 to pass therethrough. Above and surrounding the aperture 21 is a mould heating chamber 23 which comprises an outer insulating box 24 having contained therein known radiant heating means 25 having appropriate power supply and control means (not shown) attached thereto. In the top of the insulation box 24 is an aperture having a pouring tube 27 therein to guide the molten metal into the mould 22 on pouring. Below the vacuum chamber 11 is a mould chamber 30. The mould chamber 30 is attached in sealed engagement to the bottom wall 20 of the casting chamber 11. The chamber 30 may be isolated from the chamber 11 by means of the isolation valve 31 and seal 32. The valve 31 may be moved between the open position (FIG. 1) and the closed position (FIG. 2) by suitable known remotely operated control means (not shown). Cooling passages 33 are provided around the chamber walls. The chamber 30 has a door 34 in the one side wall to allow positioning and subsequent removal of the mould 22, the door 34 is sealable to the chamber wall 35. Also provided in the chamber wall 35 is a vacuum pumping port 36 connected to a vacuum pump (not shown) via a valve 37. A further port 38 in the wall 35 is provided to supply fluid under pressure from a fluid supply source (not shown) via a valve 39. The mould 22 is mounted on a table 40 but insulated therefrom by an insulation block 41. The table 40 is itself mounted on the top of a movable ram 43 which slides in sealed engagement through the bottom wall 44 of the chamber 30. The table 40 and ram 43 are provided with passages 45 for cooling water. The ram 43 is powered hydraulically but may be powered electrically and moves the mould 22 between the chambers 11 and 30.

In operation the chamber 11 is pumped down to a low pressure which is commensurate with the requirements of the alloy being cast. The valve 31 will be closed and the ram 43 and table 40 retracted to their lowest level. The metal in the crucible 14 will be melted down and the temperature raised and stabilised at that required. The mould 22 and insulation block 41 will be placed on the table 40 via the door 34 which is then closed and sealed, the chamber 30 then being evacuated to the same or similar pressure to that of chamber 11. Once at the appropriate pressure the valve 31 is opened and the mould and associated supports raised by the ram into the mould heating chamber 23 (FIG. 1). The mould temperature is then raised by means of the radiant heaters 25 to the desired temperature. Once the mould 22 and the metal 15 are both stabilised at the desired temperature the metal is poured into the mould. Immediately the metal has been cast the ram 43 is retracted into the chamber 30, the valve 31 is closed, valve 37 is also closed and valve 39 opened to admit pressurising fluid which may be argon gas, for example (FIG. 2). The chamber is rapidly pressurised to a pressure less than 7 MPa. The molten metal is thus allowed to solidify under gas pressure which tends to preclude shrinkage porosity void formation by pressurisation, thus continuously feeding liquid metal between the randomly growing grains of the solidifying mass. Whilst the solidification is proceeding in chamber 30 the crucible 14 may be recharged with fresh metal via the port 16 and vacuum lock 17 and the metal melted ready for the next mould.

Figure 3:
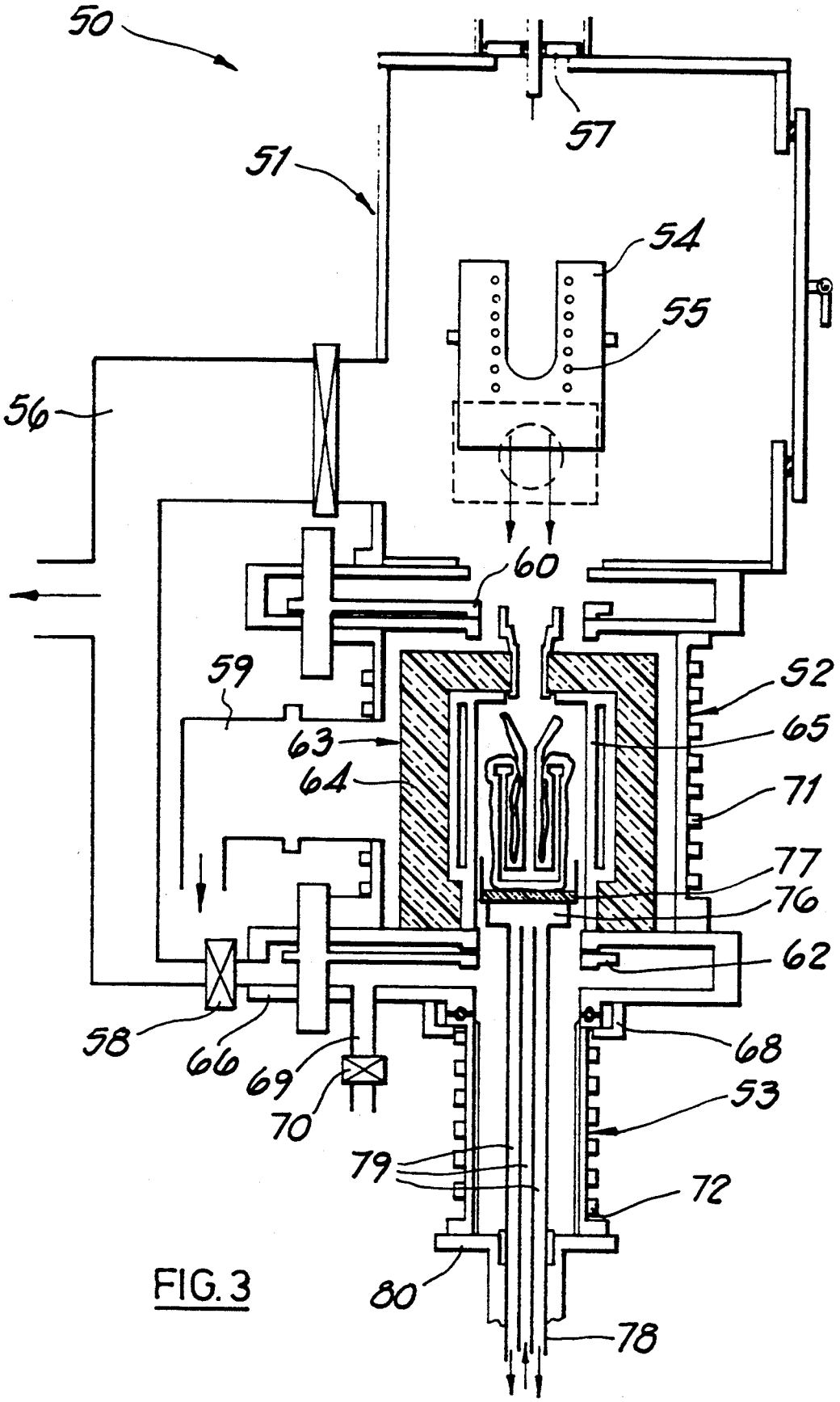
FIG. 3 shows a schematic section through a second embodiment of apparatus according to the present invention with a mould therein immediately prior to casting molten metal.
Figure 4:
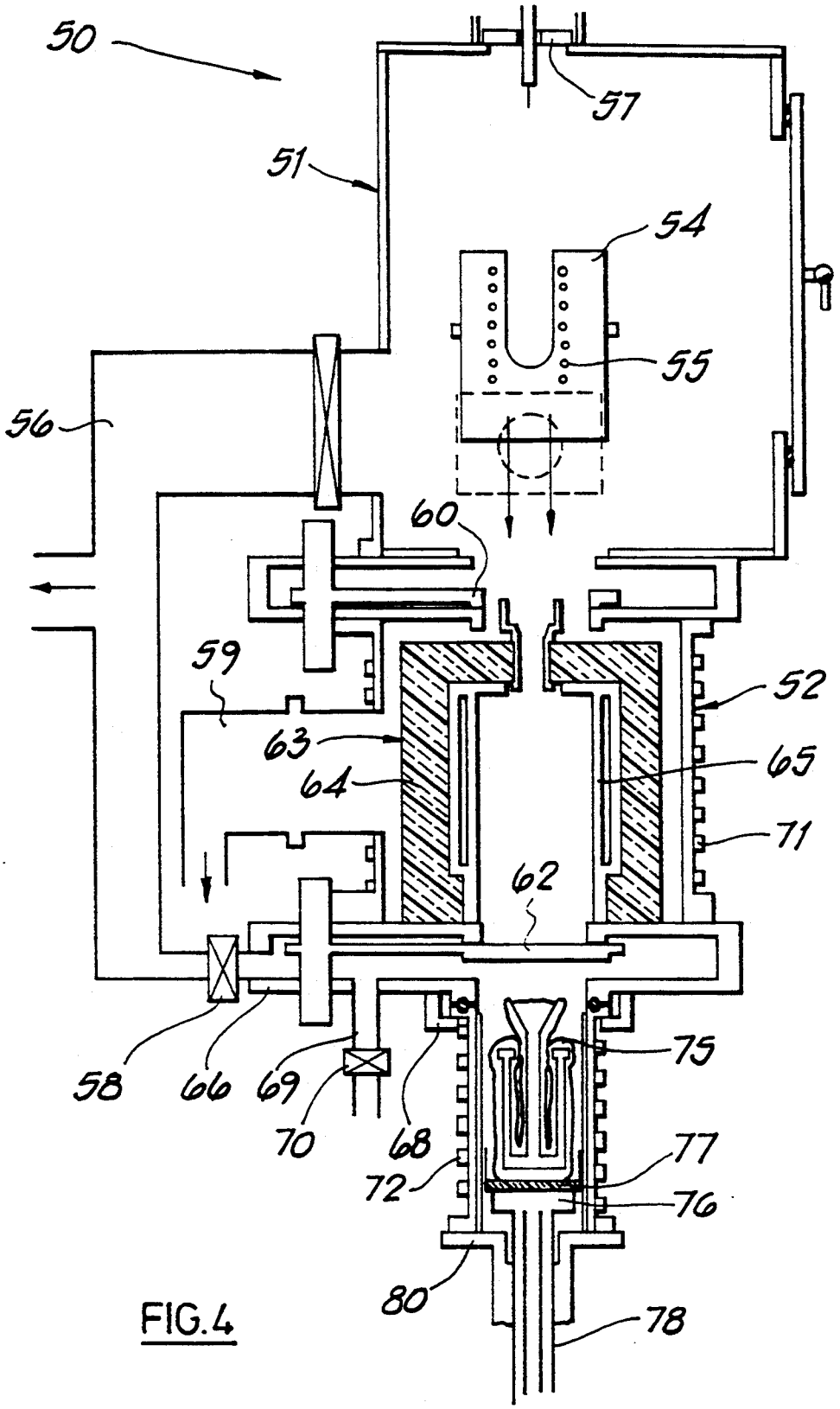
FIG. 4 shows the apparatus of FIG. 3 after casting of molten metal.

Referring now to FIGS. 3 and 4 and where the same features are denoted by common reference numerals. A vacuum casting and pressure solidification apparatus is shown generally at 50. The apparatus comprises a melting and pouring chamber 51, a mould heating chamber 52 and a mould vacuum/pressurisation chamber 53. All three chambers may be mutually isolated by appropriate valves as will be described below. The melting and pouring chamber 51 includes a crucible 54 heated by induction coils 55. Metal may be charged into the crucible 54 by removal of the port cover 57. The chamber is evacuated via a duct 56 which is connected to both vacuum pump means (not shown) and to the mould vacuum/pressure chamber 53 via a manifold 66. The chamber 51 may be isolated from chamber 53 by a valve 58 in the duct 56. The chamber 52 is evacuated via duct 59 also connected to vacuum pump means (not shown). Chamber 51 may be isolated from chamber 52 by the swinging arm valve 60. Chamber 52 may be isolated from chamber 53 by the swinging arm valve 62. Chamber 52 houses mould heating means 63 which comprises insulation 64 and radiant heaters 65. The chamber 53 is held against the manifold 66 with an intervening seal 68. The manifold 66 is further provided with a conduit 69 and valve 70 to admit fluid under pressure from a source of pressurised fluid (not shown) such as bottled gas, for example. The chambers 52 and 53 are provided with external water cooling pipes 71,72 respectively. A mould 75 is supported on a table 76 via an insulating block 77, the table being mounted on a movable ram 78. The table 76 and ram 78 have water cooling passages 79 therein. The ram is in sealed sliding engagement with the bottom cover 80 of the chamber 53. The chamber 53 is itself movable relative to the manifold 66 by means of a hydraulically operated mechanism (not shown) on which the chamber 53 and the associated ram 78 is mounted. The mechanism moves the chamber 53 and associated apparatus in a downwardly and outwardly direction to allow access to the interior of the chamber 53.

Operation of the apparatus is essentially similar to that described with reference to the apparatus of FIGS. 1 and 2.

The chamber 51 is initially closed by the valves 60 and 58 from chambers 52 and 53 and evacuated via the duct 56. The mould 75 is placed into the chamber 53 and the chamber then placed against the seal 68. Evacuation of chamber 53 may proceed by opening of valve 58. Chamber 52 is also initially isolated from chamber 53 by valve 62 and is evacuated via duct 59. Once evacuation of chambers 51,52 and 53 has been completed to the desired pressure or pressures the valve 62 is opened and the mould elevated from chamber 53 to chamber 52 on the ram 78 and associated table 76 and insulation 77. Whilst the metal is being melted and stabilised at a desired temperature the mould is pre-heated by the radiant heating means 65 to a desired temperature. When the metal is near to its desired temperature the valve 60 is opened. After pouring of the metal into the mould the filled mould is immediately retracted into the chamber 53, the valves 58 and 62 closed and the valve 70 opened to allow pressurising fluid into the chamber 53 up to a maximum pressure of 7 MPa. The metal in the mould is thus allowed to solidify under isostatic gas pressure.

Figure 5:
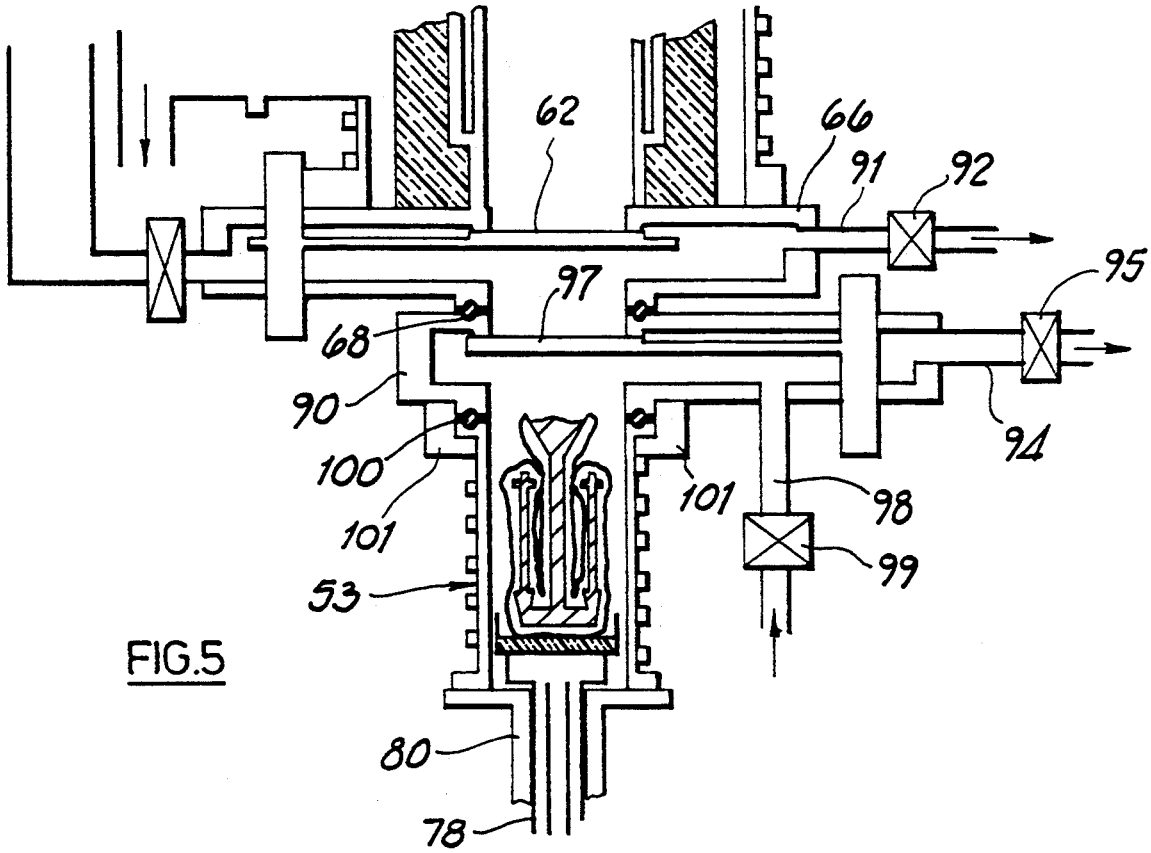
FIG. 5 shows a modification of apparatus similar to that of FIGS. 3 and 4.

FIG. 5 shows a modification of the apparatus of FIGS. 3 and 4 where the chamber 53 may be separated from the chamber 52 and manifold 66 without breaking either the vacuum in chambers 51 and 52 or reducing the pressure in chamber 53.

The apparatus 50 is essentially similar to that shown in FIGS. 3 and 4 but is further provided with a second manifold 90 which seals against the seal 68 of the manifold 66. The pressurised fluid conduit 69 and valve 70 are omitted from manifold 66 in this embodiment and are replaced with a vacuum duct 91 and valve 92 connected to vacuum pump means (not shown). The manifold 90 is provided with a vacuum duct 94 and valve 95 which are connected to vacuum pump means (not shown) for independently evacuating chamber 53. Also provided in manifold 90 are swinging arm valve 97, pressurised fluid inlet conduit 98 and control valve 99 of which the latter two are connected to a source of pressurised fluid (not shown). The chamber 53 seals against the manifold 90 by means of seal 100 and is held thereto by appropriate clamps 101. The chamber/manifold assembly 53, 90 etc. is movable as a unit and may be detached from the seal 68/ manifold 66 whilst still pressurised by means of a hydraulically or electrically operated mechanism (not shown) which moves the chamber and manifold assembly containing the filled mould metal away and which is replaced with a second, similar chamber and manifold assembly containing a fresh empty mould. In this manner the production rate may be increased since the casting apparatus is available whilst the metal is solidifying.

Solidification of the metal in the mould occurs mainly through the mechanism of radiation to the walls of the mould chamber from where the heat is abstracted by the cooling passages 72. It may be desirable in some instances to prevent rapid heat extraction and to control the rate of cooling. This may be achieved as shown in FIG. 6 by means of insulating members 110 positioned in the mould chamber. Such members 110 may vary in shape, thickness, material etc. depending inter alia upon the configuration and dimensions of the parts being cast. Materials may comprise stiffened ceramic fibre blankets of alumina, silica or zirconia, for example.

The most common pressurising fluid may probably be argon; however, other gasses may be used including helium, nitrogen and air, the choice being mainly dictated by the materials being cast. Although more expensive than argon, helium may be used to accelerate the cooling rate if that is desirable in some circumstances.

The various embodiments of apparatus described herein although primarily intended for the production of low porosity EA turbine components may also be utilised for the production of DS and SX components. The apparatus may be equipped with known microprocessor based control systems controlling the heating applied by the radiant heaters and the withdrawal rate of the ram etc. For producing the DS or SX components the insulation between the mould and the ram table is removed and the mould constructed directly on the water cooled ram table or on a separate chill plate to achieve directional heat abstraction and a subsequently planar solid/liquid interface by the slow, controlled withdrawal of the filled mould from the casting chamber.

Thus apparatus is provided which is completely flexible in the tasks that it may perform leading to improved production efficiency and reduced costs.

It is further envisaged that the technique and apparatus may be applied to the production of components other than those destined for gas turbine engines or turbochargers. For example, components may be cast in materials which do not require a vacuum for protection. Thus components may be cast in air and retracted into a pressure chamber for the solidification phase.

We claim:

1. Apparatus for the production of cast metal components, the apparatus comprising a mould, a casting chamber, metal melting and metal pouring means, a mould chamber adjacent said casting chamber and connected thereto by valve means of sufficient size to allow said mould to pass therethrough, vacuum pump means for producing a reduced pressure in at least said casting chamber, mould heating means, mould moving means to transport said mould between said mould chamber and said casting chamber, and pressurising means connected to said mould chamber for pressurising said mould chamber with a fluid, to a pressure sufficient to achieve at least substantial reduction in shrinkage porosity void formation during solidification of molten metal in the mould chamber wherein said valve means, said mould moving means and said pressurising means are constructed and arranged such that a mould with molten metal therein can be moved from said casting chamber to said mould chamber, said valve means closed and said mould chamber pressurized, all within a time such that said metal is still molten.

2. Apparatus according to claim 1 wherein said mould chamber is detachable from said casting chamber and is replaceable by a second mould chamber.

3. Apparatus according to claim 1 and having first and second valve means interposed between said casting chamber and said mould chamber such that the two said chambers may be separated whilst maintaining a reduced pressure in said casting chamber and maintaining a reduced pressure or an increased pressure in said mould chamber.

4. Apparatus according to claim 1 further including insulation means in said mould chamber to control the rate of cooling of selected regions of a mould.

5. Apparatus as claimed in claim 1 wherein said time is within forty seconds from the finish of pouring of the molten metal in said casting chamber.

6. Apparatus as claimed in claim 1 wherein said pressurising means can pressurize said mould chamber up to about 7 MPa.

7. A process for the production of castings, the process comprising the steps of at least partially melting a metal charge, pouring said metal into a mould which is in a first chamber, withdrawing the filled mould completely into a second chamber while the metal in the mould is still in a molten state, isolating said second chamber from said first chamber with regard to pressure and then pressurising said second chamber with a fluid up to a maximum pressure of 7 MPa such as to preclude shrinkage porosity void formation for at least part of the time required for solidification of the metal in the mould.

8. A process according to claim 7 wherein said second chamber is pressurised within 40 seconds from the finish of pouring of the molten metal.

9. A process according to claim 8 wherein said second chamber is pressurised within 20 seconds from the finish of pouring of the molten metal.

10. A process according to claim 7 wherein said mould is heated within said first chamber.

11. A process according to claim 10 wherein said mould is heated in said first chamber to a temperature in excess of the melting point of the alloy being cast.

12. A process according to claim 7 wherein the metal being cast is selected from the group consisting of iron, nickel or cobalt-based alloys.

* * * * *